United States Patent [19]

Abbaschian et al.

[11] Patent Number: 4,643,779

[45] Date of Patent: Feb. 17, 1987

[54] METHOD OF MAKING ALUMINUM-LITHIUM ALLOYS WITH IMPROVED DUCTILITY

[75] Inventors: Gholamreza J. Abbaschian, Gainesville, Fla.; Stephen Abeln, Arvada, Colo.

[73] Assignee: University of Florida, Gainesville, Fla.

[21] Appl. No.: 661,818

[22] Filed: Oct. 17, 1984

[51] Int. Cl.[4] ..... C22F 1/04

[52] U.S. Cl. ..... 148/11.5 A; 148/12.7 A; 148/125

[58] Field of Search ..... 148/11.5 A, 12.7 A, 148/125, 415–418, 437–440

[56] References Cited

U.S. PATENT DOCUMENTS 4,571,272 2/1986 Grimes ..... 148/11.5 A

*Primary Examiner*—R. Dean

*Attorney, Agent, or Firm*—Kerkam, Stowell, Kondracki, Clarke

[57] ABSTRACT

A method for improving the ductility of aluminum based alloys containing lithium comprising deforming the alloy below about −50° C. so as to achieve a reduction in the cross-sectional area of the alloy of at least about 15%.

10 Claims, No Drawings

METHOD OF MAKING ALUMINUM-LITHIUM ALLOYS WITH IMPROVED DUCTILITY

The invention herein described was made in the course of contract N00014-81-K-0730 awarded by the Office of Naval Research.

BACKGROUND OF THE INVENTION

1. Field of the Invention

The present invention relates to an improvement in the formability and mechanical properties of aluminum-lithium alloys.

2. Prior Art

Lithium, the lightest metal occurring in nature has been alloyed with aluminum to reduce the density thereof. Aluminum-lithium alloys are highly coveted for applications requiring high strength, high elastic modulus and low density such as in the aerospace industry. [Mehrabian et al, Rapid Solidification Processing Principles and Technology II, Claitor's Pub. Div. (1980)]. The alloys have not found wide commercial acceptance, however, in view of their unacceptable ductility, fracture toughness and notch sensitivity values and the concomitant difficulty of fabrication of articles therefrom. These poor properties have been attributed to the use of δ' phase alloys produced by the conventional precipitation hardening mechanism within the δ' solvus. [Sanders et al, Aluminum-Lithium Alloys, Proc. 1st. Int. Al-Li Conf., Stone Mountain, Ga., TMS-AIME, (1980)].

It is an object of the present invention to provide a method of strengthening which greatly improves the ductility, formability and other mechanical properties of aluminum-lithium alloys.

SUMMARY OF THE INVENTION

The present invention provides a method for improving the ductility of aluminum based alloys containing lithium comprising deforming the alloy at a temperature considerably below room temperature, e.g., below about −50° C. so as to achieve a reduction in the cross-sectional area of the alloy of at least about 15%.

The present invention also provides a method for increasing the strength of the alloy through dispersion hardening by heating the deformed alloy to a temperature at or above the δ' solvus.

The invention also provides novel aluminum-lithium alloys produced according to the above-described methods.

DETAILED DESCRIPTION OF THE INVENTION

Attempts to form conventional aluminum-lithium alloys consistently result in failure due to the poor ductility characteristics of the alloys. Although methods involving the rolling or working of aluminum-lithium alloys at or above room temperature have been reported in the literature [Ali et al, Soobshen, Akad, Nawk Gruz. SSR 1979, 94(1), 65–8, C.A. 91: 127377n (1979); U.S.S.R. Pat. No. 624,953 (1977), C.A., 90: 42941W (1979); Doelling et al, Erzmetall 1979, 32(4), 161–5, C.A. 91: 25545y (1979)], the alloys produced thereby are highly susceptible to fracturing.

Studies of alloys rolled at room temperature reveal fractures typical of alloys deformed by planar slip. Alloys rolled at elevated temperatures also display fracturing normally associated with planar slip or alloy depleted zones on the surface and grain boundaries leading to substrate pits and inhomogeneous deformation that promote cracks which propagate throughout the base material.

The present invention is predicated on the discovery that deformation of aluminum-lithium alloys at cryogenic temperatures greatly improves the ductility of the alloy. While not wishing to be bound by any theory as to the mechanism of the invention, it is believed that deformation of the alloy at low temperatures promotes twinning as well as dislocation slip, both of which are responsible for excellent ductility characteristics. Twinning apparently provides new orientations favorable for continued slip and, hence, more uniform deformation. It is further theorized that the reduction in temperature may cause a reduction in the stacking fault energy (SFE) of the alloy since twin formation requires a low SFE, or may raise the flow stress for slip such that the critical twinning stress was reached before slipping occurred to any great extent.

It has been reported in the literature that there is a trend toward twinned or reoriented structure at reduced temperatures in some metals. Venables [Deformation Twinning in fcc Metals, Metallurgical Society Conferences—Mar. 21–22, 1963, Ed: Reed-Hill et al, Gordon & Breach Sueine Pub., N.Y., London (1964)] has reported the results of research which indicates that single crystals of copper of certain orientations twin at high stresses in liquid helium. Venables further reports that other researchers found similar behavior in silver-gold alloys, single nickel crystals and α-brass, but indicates that aluminum and lead do not twin at the highest stresses reached at low temperatures.

Improved ductility does not appear to be merely temperature dependent, however. The composition of the alloy, thermal history thereof and the degree of deformation also appear to be critical to enhanced ductility on deformation. Thus, alloys which have been aged did not twin and fractured early in the deformation process. Moreover, a critical strain is required for the onset of twinning, generally at least a 15% reduction in cross-sectional area (RA).

Solutionized and water-quenched alloys most readily lend themselves to the cryogenic deformation of method of the invention. The alloys may be prepared according to any conventional solutionization method, i.e., (a) heat the alloy to the maximum solution temperature without incipient melting; (b) maintain the temperature to insure uniform temperature in the sample and to dissolve the alloying elements in the aluminum matrix, and (c) quench the alloy by immersion in a circulated water or brine solution. The solutionized and water-quenched alloy is then cooled to a cryogenic temperature, (for example, by immersing in liquid nitrogen), and mechanically deformed at this temperature. The deformed sample, which is highly defective in atomic scale, is finally heated to above the δ' solvus line for a suffient length of time (in the range of 1–30 minutes) so that fine precipitates form throughout the defective structure. Final cooling or quenching of the alloy to room temperature results in a material with improved ductility as well as improved yield and tensile strength.

Typical additions may be included in the alloys processed according to the invention, e.g., magnesium, zirconium, copper, iron, manganese, silicon, boron, titanium, nickel, chromium, beryllium, cadmium, and any other element or mixtures thereof which form stable compounds with Al and Li, strengthens the aluminum matrix and grain refines the matrix.

The invention is also predicated on the further discovery that cryogenic deformation also creates a highly defective structure which permits nucleation of second phase precipitates at or near the defects thus strengthening the alloy during subsequent heat treatment. This is particularly true of aluminum-lithium alloys containing magnesium inclusions which, on heating to temperatures at or above the δ' solvus, form $Al_2LiMg$ precipitates which nucleate at the defects produced by cryogenic deformation thereby greatly enhancing the strength characteristics of the alloy in addition to the improved ductility thereof.

Again, not wishing to be bound by any theory, it is thought that the subsequent heat treatment results in a change of the strengthening phase from the coherent ($Al_3Li$) to a semicoherent or incoherent strengthening phase. The chemical composition of the precipitates will depend, of course, upon the alloy composition. For example, for aluminum alloys containing Li and Mg, the strengthening phase by this new technique consists essentially of fine precipitates of $Al_2LiMg$ which are distributed uniformly throughout the matrix. If the alloy contains only Li, the precipitates will comprise AlLi. These precipitates can also be formed by other conventional techniques. However, in contrast to those of the present invention, the conventional precipitates are much coarser, are not uniformly distributed, and preferentially form at the grain boundaries.

Aluminum-lithium alloys of the following compositions are susceptible to transformation according to the method of the invention to novel alloys having improved ductility and strength characteristics.

TABLE 1

| Element | | Weight |
|---|---|---|
| lithium | max: | 10 |
| magnesium | | 0 to 10 |
| zirconium | | 0 to 3 |
| copper | | 0 to 10 |
| iron | | 0 to 10 |
| manganese | | 0 to 2 |
| silicon | | 0 to 10 |
| aluminum | | balance |

In addition, the alloys may contain minor amounts of other additives such as B, Ti, Ni, Cr, Be, Cd, etc.

The alloys are reduced to a cryogenic temperature below about −50° C., preferably to about −200° C., conveniently by immersion in liquid nitrogen until the alloy has reached a uniform temperature. Deformation may be achieved according to any conventional technique, e.g., rolling, forging, stretching, etc., until a reduction in area (RA) from about 15 to about 38% is reached.

The invention is illustrated by the following nonlimiting examples. In each example, the alloy was prepared by packing rapidly solidified, atomized powders of the constituent metals in aluminum cans 2 inches in diameter and 2 inches long. The cans were welded shut under a $10^{-4}$ atmosphere vacuum and extruded at 375°-400° C., with an extrusion ratio of about 24. The extruded alloy was solutionized at 500°-525° C. and water quenched. Cryogenic cooling was achieved by immersion of the alloy in liquid nitrogen. Deformations and reductions were achieved by rolling. All percentages are by weight unless otherwise indicated.

EXAMPLE 1

Solutionized and water-quenched alloy samples (1 in gage length at 0.11×0.255 in. cross-section) of Al, 3% Li, 5.5% Mg, 0.2% Zr prepared as described above were reduced by 35% and 20% RA. Identical samples were processed conventionally as controls. The mechanical properties of the samples were measured and are compared in Table 2.

TABLE 2

| | Avg. Y.S., Psi | Avg. T.S., Psi | Avg. Elongation, % |
|---|---|---|---|
| 35% cryo-rolled and precipitation heat treated at 350° C. for 10 minutes | 39,153 psi | 63,068 psi | 5.3% |
| 20% cryo-rolled and precipitation heat treated for 350° C. for 10 minutes | 28,770 psi | 59,530 psi | 5.5% |
| Hot rolled at 420° C., solutionized, water quenched, and aged at 200° C. for 24 hours | 48,695 psi | 65,199 psi | 2.2% |
| Hot rolled at 420° C., solutionized, water quenched, and aged at 200° C. for 50 hours | 38,484 psi | 71,381 psi | 2.8% |
| Hot rolled at 420° C., solutionized, water quenched, and aged at 200° C. for 72 hours | 23,746 psi | 45,459 psi | 2.5% |

These results evidence the improved ductility of the alloys treated according to the method of the invention as compared with conventional processing.

These results evidence the improved ductility of the alloys treated according to the method of the invention as compared with conventional processing.

EXAMPLE 2

Solutionized and water-quenched samples prepared as in Example 1 were subjected to the processing methods set forth in Table 3 and their mechanical properties compared.

TABLE 3

| | Specimens | Y.S. (Ksi) Average (Range) | T.S. (Ksi) Average (Range) | Elongation (%) Average (Range) |
|---|---|---|---|---|
| Conventional Process | | | | |
| Aged at 200° C. for 5 hrs | 2 | 34.5 (29.3-39.7) | 48.5 (43.1-53.9) | 2.7 (2.2-3.2) |
| Aged at 200° C. for 24 hrs | 2 | 48.7 (40.0-57.4) | 65.2 (59.1-71.3) | 2.2 (2.0-2.4) |
| Aged at 200° C. for 50 hrs | 3 | 32.5 (37.0-40.9) | 71.4 (63.8-77.2) | 2.8 (2.0-3.8) |
| Aged at 200° C. for 72 hrs | 2 | 23.7 (20.8-26.7) | 45.5 (41.6-49.4) | 2.5 (2.2-2.8) |
| Conventional Cold Rolling | | | | |
| 10% cold roll (R.T.) and precipitation heat treated at 350° C. for 10 min. | 3 | 29.2 (29.3-30.2) | 57.1 (55.6-59.2) | 6.0 (5.2-7.3) |
| Cryo-Rolling | | | | |
| 35% cryo-rolled and precipitation heat treated at 350° C. for 10 min. | 7 | 37.7 (35.6-40.0) | 61.3 (59.4-64.1) | 5.4 (4.0-6.2) |
| 20% cryo-rolled and precipitation heat treated at 350° C. | 4 | 35.3 (34.8-55.5) | 59.3 (54.8-61.7) | 5.5 (3.5-6.5) |

TABLE 3-continued

| | Specimens | Y.S. (Ksi) Average (Range) | T.S. (Ksi) Average (Range) | Elongation (%) Average (Range) |
|---|---|---|---|---|
| for 10 min. | | | | |
| 35% cryo-rolled and precipitation heat treated at 350° C. for 5 min. | 2 | 38.7 (38.1–39.4) | 60.8 (60.4–61.2) | 4.4 (4.0–4.9) |
| 20% cryo-rolled and precipitation heat treated at 350° C. for 5 min. | 2 | 35.3 (34.4–36.3) | 58.8 (57.0–60.6) | 4.9 (4.6–5.2) |
| 20% cryo-rolled and precipitation heat treated for 10 min. plus 5 hrs. at 200° C. | 3 | 33.8 (33.5–34.0) | 56.2 (54.7–58.6) | 3.2 (2.8–3.8) |
| 35% cryo-rolled and precipitation heat treated at 200° C. for 5 hrs | 3 | 53.8 (52.4–55.2) | 67.5 (65.7–70.9) | 1.7 (1.2–2.3) |

It should be noted that although conventional cold rolling gives elongations similar to the cryo-rolling method of the present invention the former suffers from two main disadvantages; (1) The samples can only be deformed (rolled) up to about 15% before fracturing occurs, as compared with the more than 35% RA achievable by the method of the invention (cryo-rolling). (2) The yield strength and tensile strength of the cold rolled material are considerably lower than the cryo-rolled samples: 29.2 and 57.1 Ksi, compared with 37.7 and 61.3 Ksi, respectively.

What is claimed is:

1. A method for improving the ductility of aluminum-based alloys containing lithium comprising reducing the temperature of said alloy to a cryogenic temperature, below about −50° C. and deforming said alloy so as to achieve a reduction in the cross-sectional area of said alloy of at least about 15%, said aluminum-lithium alloy containing:

| ELEMENT | | WEIGHT |
|---|---|---|
| lithium | max; | 10 |
| magnesium | | 0 to 10 |
| zirconium | | 0 to 3 |
| copper | | 0 to 10 |
| iron | | 0 to 10 |
| manganese | | 0 to 2 |
| silicon | | 0 to 10 |
| aluminum | | balance |

and/or minor amounts of other elements which combine with Al and Li to form a second phase compound therein, strengthen the aluminum matrix and/or grain refine the alloy.

2. The method of claim 1 including the step of dispersion hardening the deformed alloy by heating to a temperature at or above the δ′ solvus thereby to increase the strength of said alloy.

3. The method of claim 1 or 2 wherein said aluminum-lithium alloy additionally contains magnesium.

4. The method of claim 1 or 2 wherein said aluminum-lithium alloy additionally contains zirconium.

5. The method of claim 1 or 2 wherein said aluminum-lithium alloy additionally contains magnesium and zirconium.

6. The method of claim 1 or 2 wherein the temperature of said alloy is reduced to a temperature below about −200° C.

7. The method of claim 1 or 2 wherein said deformation is accomplished by rolling.

8. The method of claim 1 or 2 wherein said deformation is accomplished by forging.

9. The method of claim 1 or 2 wherein said deformation is accomplished by stretching.

10. The method of claim 1 or 2 wherein said aluminum-lithium alloy comprises an alloy prepared by solutionization of the constituent elements followed by quenching.

* * * * *